US010821587B2

(12) United States Patent
Meyer et al.

(10) Patent No.: US 10,821,587 B2
(45) Date of Patent: Nov. 3, 2020

(54) STAPLING TOOL ASSEMBLY INCLUDING A WIRE ALIGNMENT CONTACT TRIP

(71) Applicant: Black & Decker Inc., New Britain, CT (US)

(72) Inventors: Jeffrey J. Meyer, Los Gatos, CA (US); Dylan Parker, Towson, MD (US)

(73) Assignee: Black & Decker Inc., New Britain, CT (US)

( * ) Notice: Subject to any disclaimer, the term of this patent is extended or adjusted under 35 U.S.C. 154(b) by 159 days.

(21) Appl. No.: 15/974,448

(22) Filed: May 8, 2018

(65) Prior Publication Data

US 2019/0299382 A1 Oct. 3, 2019

Related U.S. Application Data

(63) Continuation-in-part of application No. 15/941,432, filed on Mar. 30, 2018, now abandoned.

(51) Int. Cl.

| | |
|---|---|
| ***B25C 5/16*** | (2006.01) |
| ***B25C 5/06*** | (2006.01) |
| ***B25C 5/00*** | (2006.01) |
| ***B25C 5/02*** | (2006.01) |

(52) U.S. Cl.
CPC ..... *B25C 5/02* (2013.01)

(58) Field of Classification Search
CPC .. B25C 5/06; B25C 1/047; B25C 5/00; B25C 5/0257; B25C 5/16
See application file for complete search history.

(56) References Cited

U.S. PATENT DOCUMENTS

| | | | | |
|---|---|---|---|---|
| 2,351,044 | A | 6/1944 | Heller | |
| 2,618,779 | A | 11/1952 | Byard | |
| 4,087,035 | A | 5/1978 | Harmon | |
| 4,452,387 | A | 6/1984 | Haytayan | |
| D291,275 | S | 8/1987 | Chang | |
| 5,094,380 | A | 3/1992 | Nasiatka | |
| D349,439 | S | 8/1994 | Chou | |
| 6,131,788 | A * | 10/2000 | Marks | B25C 5/06 227/119 |
| 6,896,166 | B2 | 5/2005 | Byard | |
| 7,255,256 | B2 | 8/2007 | McGee et al. | |
| 7,290,693 | B2 | 11/2007 | Cheng | |
| 8,240,535 | B2 | 8/2012 | Shor | |

(Continued)

*Primary Examiner* — Praachi M Pathak
(74) *Attorney, Agent, or Firm* — Harness, Dickey & Pierce, P.L.C.

(57) ABSTRACT

A stapling tool assembly may include a nosepiece assembly with a driver channel through which a staple is driven into a workpiece. The stapling tool assembly may also include a wire alignment contact trip with a contact foot. The contact foot may include a peripheral guide wall that defines a workpiece contact edge. The workpiece contact edge may include at least one wire alignment recess and at least one opposing wire alignment recess in the workpiece contact edge. The at least one wire alignment recess and the at least one opposing wire alignment recess can cooperate to define a first and a second wire positioning path to align the wire in two different orientations relative to the drive channel. The at least one wire alignment recess can have a first overall length that is different than a second overall length of the at least one opposing wire alignment recess.

21 Claims, 8 Drawing Sheets

(56) References Cited

U.S. PATENT DOCUMENTS

| | | | | |
|---|---|---|---|---|
| 8,496,151 | B2 | 7/2013 | Shor | |
| 9,469,021 | B2 | 10/2016 | Gregory et al. | |
| 9,486,904 | B2 | 11/2016 | Gregory et al. | |
| 2002/0121069 | A1* | 9/2002 | Smeja | E04D 5/142 52/746.11 |
| 2003/0038153 | A1* | 2/2003 | Chen | B25C 5/00 227/140 |
| 2011/0049216 | A1* | 3/2011 | Mandel | B25C 5/06 227/140 |
| 2012/0118933 | A1 | 5/2012 | Zheng | |
| 2012/0118934 | A1* | 5/2012 | Shor | B25C 5/0257 227/142 |
| 2013/0320060 | A1 | 12/2013 | Gregory et al. | |
| 2013/0320063 | A1 | 12/2013 | Gregory et al. | |
| 2013/0320064 | A1 | 12/2013 | Gregory et al. | |
| 2013/0320066 | A1 | 12/2013 | Gregory et al. | |
| 2013/0320067 | A1 | 12/2013 | Gregory et al. | |
| 2014/0124562 | A1 | 5/2014 | Chen | |
| 2015/0060513 | A1* | 3/2015 | Young | B25C 5/06 227/8 |

* cited by examiner

STAPLING TOOL ASSEMBLY INCLUDING A WIRE ALIGNMENT CONTACT TRIP

CROSS-REFERENCE TO RELATED APPLICATIONS

This application is a continuation-in-part of U.S. patent application Ser. No. 15/941,432 filed on Mar. 30, 2018.

FIELD

The present disclosure relates to a stapling tool assembly including a wire alignment contact trip.

BACKGROUND

This section provides background information related to the present disclosure which is not necessarily prior art.

Stapling tools can be used to drive staples into workpieces. Such stapling tools include powered stapling tools that can use powered mechanisms to drive the staples into the workpieces. Such workpieces can include lumber, fence posts or other structural members. One use of such stapling tools is to secure a wire fencing material to a fence post. The stapling tools can be used to drive a staple into the fence post to secure the wire fencing material or other wire to the fence post. The stapling tools can include a wire alignment guide that assists a user in positioning the wire relative to the nosepiece of the stapling tool to prevent the legs of the staple from being driven into the wire.

Stapling tools can also be provided with a contact trip. Such a contact trip prevents operation of the stapling tool until the contact trip is moved from an extended, inactive position to a retracted, active position through contact with the workpiece. The disclosed wire alignment contact trip combines a wire alignment guide with a contact trip and can help prevent the stapling tool from firing until the stapling device is properly positioned relative to the wire as discussed hereinafter.

SUMMARY

This section provides a general summary of the disclosure, and is not a comprehensive disclosure of its full scope or all of its features.

In one example in accordance with the present disclosure, a stapling tool assembly may include a nosepiece assembly with a driver channel through which a staple is driven into a workpiece. The driver channel can define a drive plane along which the staple travels before exiting the driver channel. The stapling tool assembly may also include a wire alignment contact trip with a contact foot for positioning the nosepiece assembly relative to a wire to avoid a staple leg from being driven into the wire. The contact foot may include a peripheral guide wall that defines a workpiece contact edge. The workpiece contact may include at least one wire alignment recess and at least one opposing wire alignment recess in an opposing side of the workpiece contact edge. The at least one wire alignment recess and the at least one opposing wire alignment recess can cooperate to define a first wire positioning path and a second wire positioning path to align the wire in two different orientations relative to the drive plane. The at least one wire alignment recess can have a first overall length that is different than a second overall length of the at least one opposing wire alignment recess.

In one aspect, the wire alignment contact trip may be coupled to an activation switch of the stapling tool assembly that has an active state and an inactive state, and a biasing force that biases the wire alignment contact trip toward an extended position. The wire alignment contact trip may be movable against the biasing force into a retracted position. The activation switch is in the active state when the wire alignment contact trip is in the retracted position, and the activation switch is in the inactive state when the contact trip is in the extended position.

In another example in accordance with the present disclosure, a stapling tool assembly may include a nosepiece assembly including a driver channel through which a staple is driven into a workpiece. The driver channel defining a drive plane along which the staple travels before exiting the driver channel. The stapling tool assembly may also include a wire alignment contact trip that includes a contact foot for positioning the nosepiece assembly relative to a wire to avoid a staple leg from being driven into a wire. The contact foot may include a leading side and a trailing side joined together to define an enclosure. The leading side may be positioned opposite to the trailing side and include a first wire recess. The trailing side may include a second wire recess and a third wire recess. The contact foot may also include a contact trip arm joined to the contact foot and extending away therefrom. The contact trip arm can engage an activation switch of the stapling tool assembly. The stapling tool assembly can have an active state and an inactive state wherein a biasing force biasing the wire alignment contact trip toward an extended position. The wire alignment contact trip can be movable against the biasing force into a retracted position, and wherein the activation switch is in the active state when the wire alignment contact trip is in the retracted position, and wherein the activation switch is in the inactive state when the contact trip is in the extended position. The first wire recess and the second wire recess can cooperate to define a first wire positioning path to align the wire in a first path through the first wire recess and the second wire recess that is substantially perpendicular to the drive plane. The first wire recess and the third wire recess can cooperate to define a second wire positioning path through the first wire recess and the third wire recess to align the wire in a second path at an oblique crossing angle relative to the first path.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
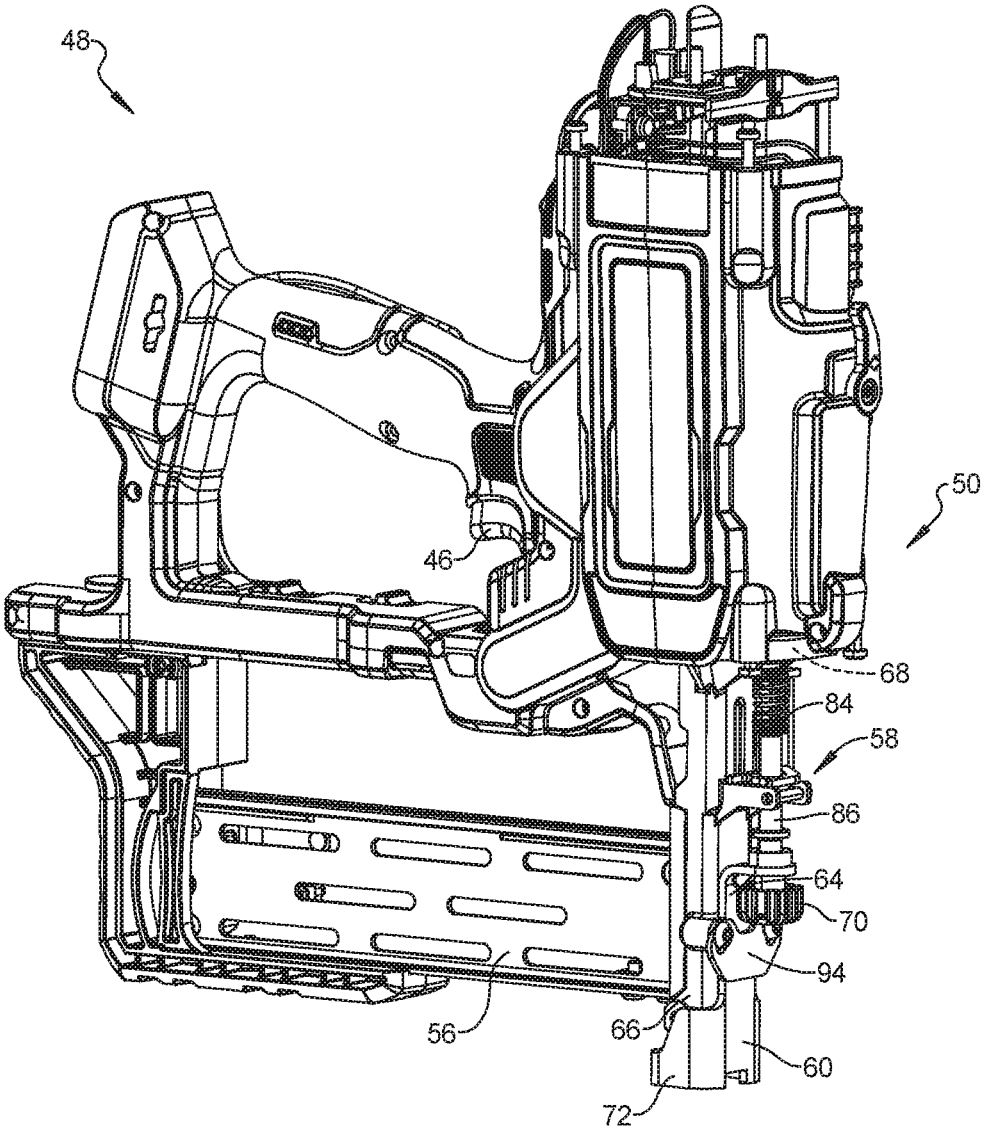
FIG. 1 is a perspective view of a stapling tool that includes an example stapling tool assembly and an example wire alignment contact trip in accordance with the present disclosure.

Example embodiments will now be described more fully with reference to the accompanying drawings.

FIGS. 1-11 illustrate example embodiments of a stapling tool assembly 50 of a stapling tool 48. Such a stapling tool assembly 50 is designed to drive a staple 52 into a workpiece 54. In the example shown in FIG. 1, the stapling tool 48 is a cordless fencing stapler. The stapling tool assembly 50 described in the present disclosure can be used, however, in connection with any suitable stapling tool such as pneumatic staplers, electric staplers, manual staplers and the like.

The stapling tool 48 includes a magazine 56 that holds a plurality of staples that are driven out of the stapling tool assembly 50 from a nosepiece assembly 58 and into a workpiece 54. The stapling tool assembly 50 also includes a wire alignment contact trip 60 that is connected at or near the ejection end of the nosepiece assembly 58. The wire alignment contact trip 60, as discussed further below, can be used to align the staple 52 (or a driving plane of the stapling tool assembly 50) relative to a wire 62 that is to be secured to the workpiece 54. Such wire alignment contact trip 60 can assist a user to avoid driving a leg of the staple 52 into the wire 62 or to otherwise damage the wire 62 when using the stapling tool 48.

The wire alignment contact trip 60 can also be used to cause the stapling tool 48 to move from an inactive state to an active state. In the inactive state, the stapling tool 48 will not drive a staple 52 into the workpiece 54 in response to a user pulling the trigger 46. In the active state, the stapling tool 48 will drive a staple 52 into the workpiece 54 when a user pulls the trigger 46. The wire alignment contact trip 60 can prevent premature actuation of the stapling tool 48 until a user has positioned the stapling tool 48 in the desired position relative to the workpiece 54.

In the example shown in FIG. 1, the wire alignment contact trip 60 includes a contact foot 72 and a contact arm 64. The contact arm 64 extends along a nose 66 of the nosepiece assembly 58 and is releasably connected to an activation switch 68 via a knob 70. The contact arm 64 is further supported along the nose 66 by a transversely oriented support bar 94 that retains the contact arm 64 in a position substantially parallel to the nose 66. In this configuration, the wire alignment contact trip 60 can move from an extended position (as shown in FIG. 1) to a retracted position in which the wire alignment contact trip 60 moves upward along the nose 66 toward the activation switch 68. This translational movement of the wire alignment contact trip 60 causes the contact arm 64 to toggle the activation switch 68 and move the stapling tool 48 between the inactive state and the active state.

The wire alignment contact trip 60 can be biased to the extended position (FIG. 1) by a biasing member 84. The biasing member 84 can be a spring or other elastomeric member that exerts a force on the wire alignment contact trip 60 in a downward direction toward the ejection end of the nosepiece assembly 58. The biasing member 84, in the example shown, is positioned on a connection rod 86 that connects the contact arm 64 to the activation switch 68. The wire alignment contact trip 60 is movable to the retracted position by applying an upward force against the biasing force to the wire alignment contact trip 60. Such upward force can be exerted on the wire alignment contact trip 60, for example, when the wire alignment contact trip 60 is pressed against the workpiece 54. The stapling tool 48, in the example shown, is the inactive state when the wire alignment contact trip 60 is in the extended position and the stapling tool 48 is in the active state when the wire alignment contact trip 60 is in the retracted position.

Figure 2:
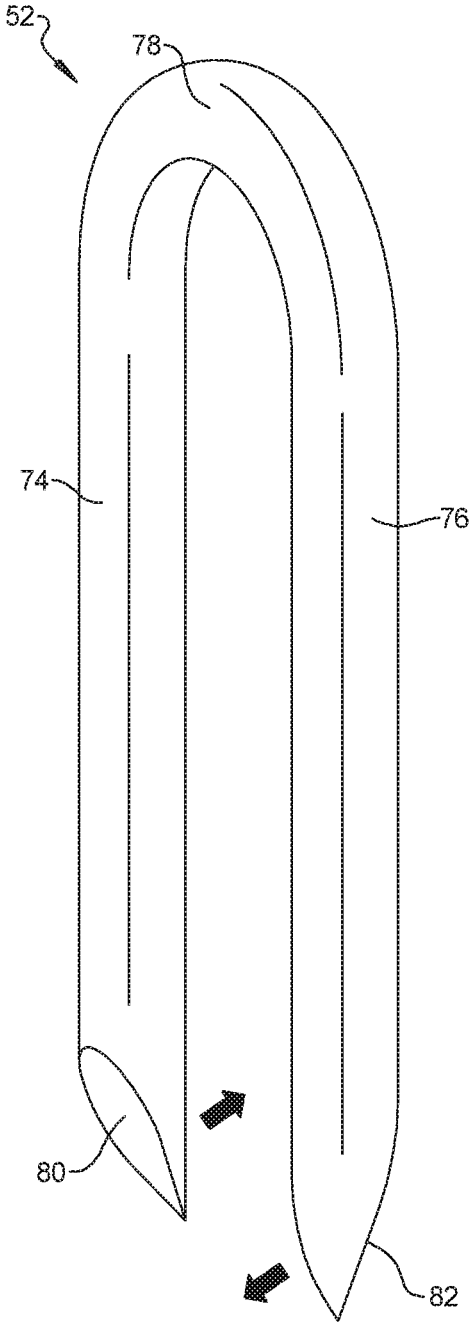
FIG. 2 is a perspective view of an example staple that can be ejected from a stapling tool that uses the example stapling tool assembly of FIG. 1.

As previously stated, the stapling tool 48 can be used drive a staple 52 into a workpiece 54 to secure a wire 62 to the workpiece 54. One example staple 52 is shown in FIG. 2. As shown, the staple 52 includes a first leg 74, a second leg 76 and a crown 78. The first leg 74 and the second leg 76 include a first insertion end 80 and a second insertion end 82, respectively. As shown, the first insertion end 80 and the second insertion end 82 can include an angled point that can cause the staple 52 to pierce the workpiece 54. In the example shown, the angled point at the first insertion end 80 and the angled point at the second insertion end 82 can be angled opposite to one another. As such, the first insertion end 80 and the second insertion end 82 can move away from each in the directions indicated by the arrows on FIG. 2. Such movement of the staple 52 can occur as the first leg 74 and the second leg 76 are driven into the workpiece 54. This movement is a consideration that is made when determining how to align the staple 52 relative to the wire 62 when the staple 52 is driven into the workpiece 54. For example, the wire alignment contact trip 60 can position the staple 52 and/or the nose 66 relative to the wire 62 at an initial orientation relative to one another such that, when the staple 52 is driven into the workpiece 54, the resulting orientation of the staple 52 relative to the wire 62 is at a final orientation. Since the staple 52 may move and/or rotate after it exits the nose 66 and is driven into the workpiece 54, the initial orientation of the wire 62 relative to the staple 52 in the nose 66 may be different from the final orientation of the staple 52 relative to the wire 62 in the workpiece 54.

Figure 3:
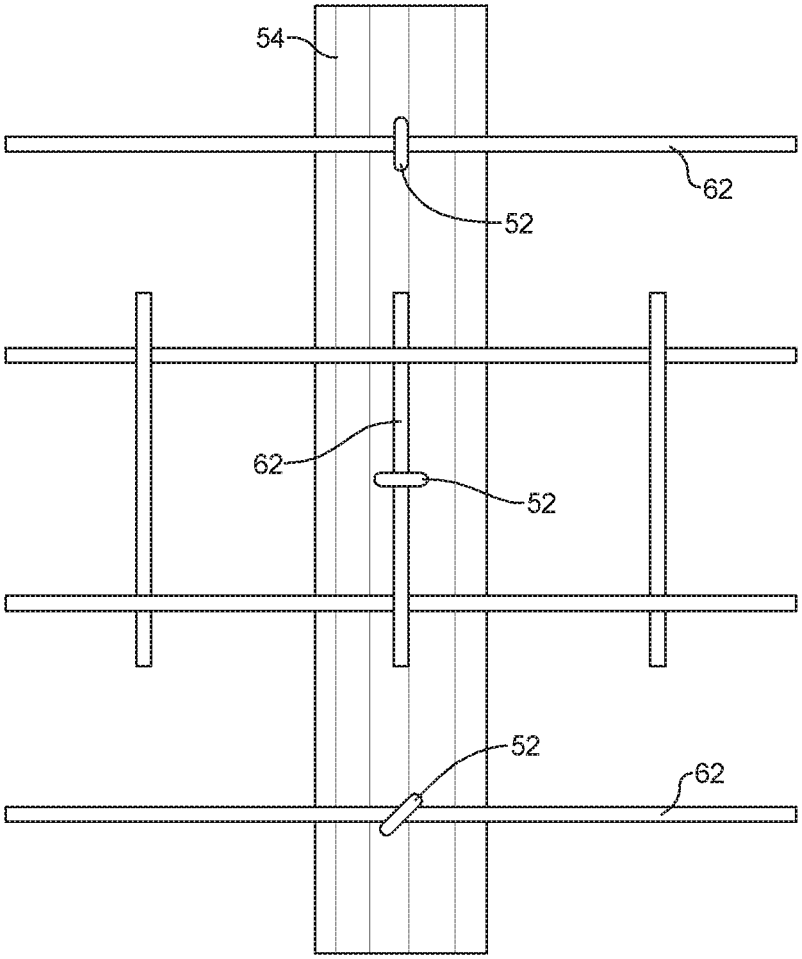
FIG. 3 is an elevation front view of an example workpiece with a wire secured to the workpiece using the example staple of FIG. 2 positioned at different orientations in the workpiece.
Figure 4:
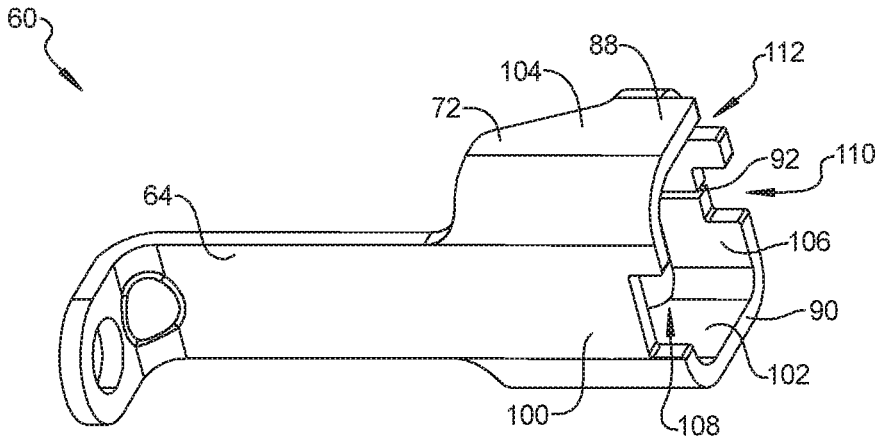
FIG. 4 is a perspective view of the example wire alignment contact trip of FIG. 1.
Figure 5:
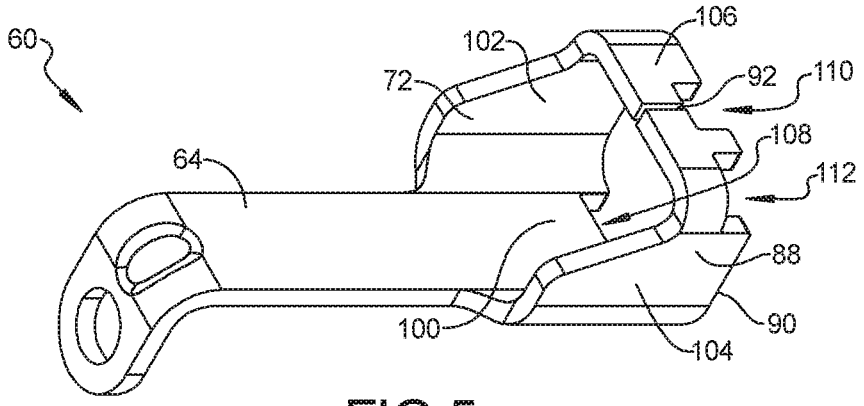
FIG. 5 is another perspective view of the example wire alignment contact trip of FIG. 4 shown from a different angle.
Figure 6:
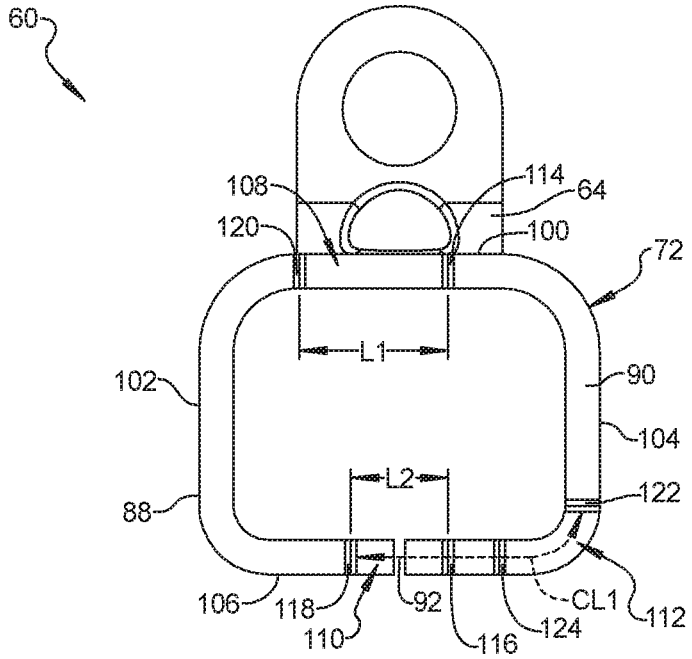
FIG. 6 is a bottom plan view of the example wire alignment contact trip of FIG. 4.

Referring now to FIG. 3, an example workpiece 54 is shown with a staple 52 securing a wire 62 to the workpiece 54. The workpiece 54, for example, can be a fence post and the wire 62 can be a stranded or solid fencing wire. At the upper portion of the workpiece 54, the staple 52 has been driven into the workpiece 54 such that the staple 52 is oriented in a first direction relative to the wire 62 in which the crown 78 of the staple is oriented substantially perpendicularly to the longitudinal direction of the wire 62. At the middle portion of the workpiece 54, the staple 52 is again driven into the workpiece at an orientation substantially perpendicular to the wire 62. In this instance, the wire 62 is part of a wire fencing material having wires 62 oriented in vertical and horizontal directions in a crisscross pattern. The staple 52 is oriented substantially perpendicular to a grain direction of the workpiece 54 and approximately 90 degrees from the direction shown at the upper portion of the workpiece 54. At the lower portion of the workpiece 54, the staple 52 has been driven into the workpiece 54 such that the staple 52 is oriented in an angled direction relative to the wire 62 in which the crown 78 of the staple 52 is oriented at a non-perpendicular crown angle relative to the longitudinal direction of the wire 62.

It can be desirable to orient the staple 52 in different directions relative to the wire 62. Such variability can be desirable given differing workpieces and differing applications in which the stapling tool 48 may be used. For example, as shown in FIG. 3, the workpiece 54 is shown as having a grain direction that follows a generally vertically oriented direction. When the staples 52 are driven into the workpiece 54, a staple 52 that is driven in the first (or substantially vertical) direction can cause the workpiece to split or fracture along the grain direction. When staples 52 are driven in the direction substantially perpendicular to the grain direction or in the second direction (or at a non-perpendicular oblique crown angle relative to the longitudinal direction and/or at a non-perpendicular crown angle relative to the grain direction), the likelihood that the workpiece 54 will split or fracture is reduced. The wire alignment contact trip 60 of the present disclosure permits a user to drive a staple 52 into a workpiece 54 at different orientations relative to the wire 62. The wire alignment contact trip 60 additionally avoids defining a path of the wire 62 that would intersect a staple leg path of the first leg 74 and/or the second leg 76 when the staple 52 is driven from nose 66.

As shown in FIGS. 4-7, one example wire alignment contact trip 60 includes the contact foot 72 and the contact arm 64. The contact foot 72, in the example shown, can include four sides that define a peripheral guide wall 88. The peripheral guide wall 88 can define an enclosure with a workpiece contact edge 90. The peripheral guide wall 88 can substantially surround the nose 66 of the nosepiece assembly 58. In the example shown, the peripheral guide wall 88 is a continuous wall that is positioned around the nose 66 with a rectangular (or square) shape. The peripheral guide wall 88, in the example shown, includes a gap 92 in a portion of the wall. In other examples, the peripheral guide wall 88 can include more gaps but the gap 92 (and/or other gaps, if any) has a width that is less than a width or diameter of the wire 62. In this manner, the wire 62 is prevented from fitting inside the gap 92. For purposes of the present disclosure, the terms "surround" or "enclose" mean that the guide wall 88 is positioned around the nose 66 such that the wire 62 cannot fit within any of the gaps that may be positioned in the guide wall 88 except for the wire alignment recesses (as will be further described below).

The workpiece contact edge 90 is an edge of the peripheral guide wall 88 that is positioned opposite to the contact arm 64. The workpiece contact edge 90 is positioned such that it contacts the workpiece 54 when the stapling tool 48 is placed into a desired orientation against the workpiece 54. When workpiece contact edge 90 is pressed against the workpiece 54, the wire alignment contact trip 60 can move against the biasing force to the retracted position and cause the stapling tool 48 to move from the inactive to the active state.

The peripheral guide wall 88, in the example shown, has a rectangular cross-sectional shape with four sides. The peripheral guide wall 88 can include a leading wall 100, a first side wall 102, a second side wall 104 and a trailing wall 106. The leading wall 100 is positioned at a forward side of the contact foot 72 adjacent to the drive plane DP. The trailing wall 106 is positioned at a back side of the contact foot 72 and is spaced further from the drive plane DP than the leading wall 100. The first side wall 102 and the second side wall 104 extend between the leading wall 100 and the trailing wall 106 to define the enclosure or peripheral guide wall 88. In other examples, the peripheral guide wall can have other shapes or profiles such as a circle shape, a D-shape, an oval shape, a trapezoidal shape or other shapes.

Figure 7:
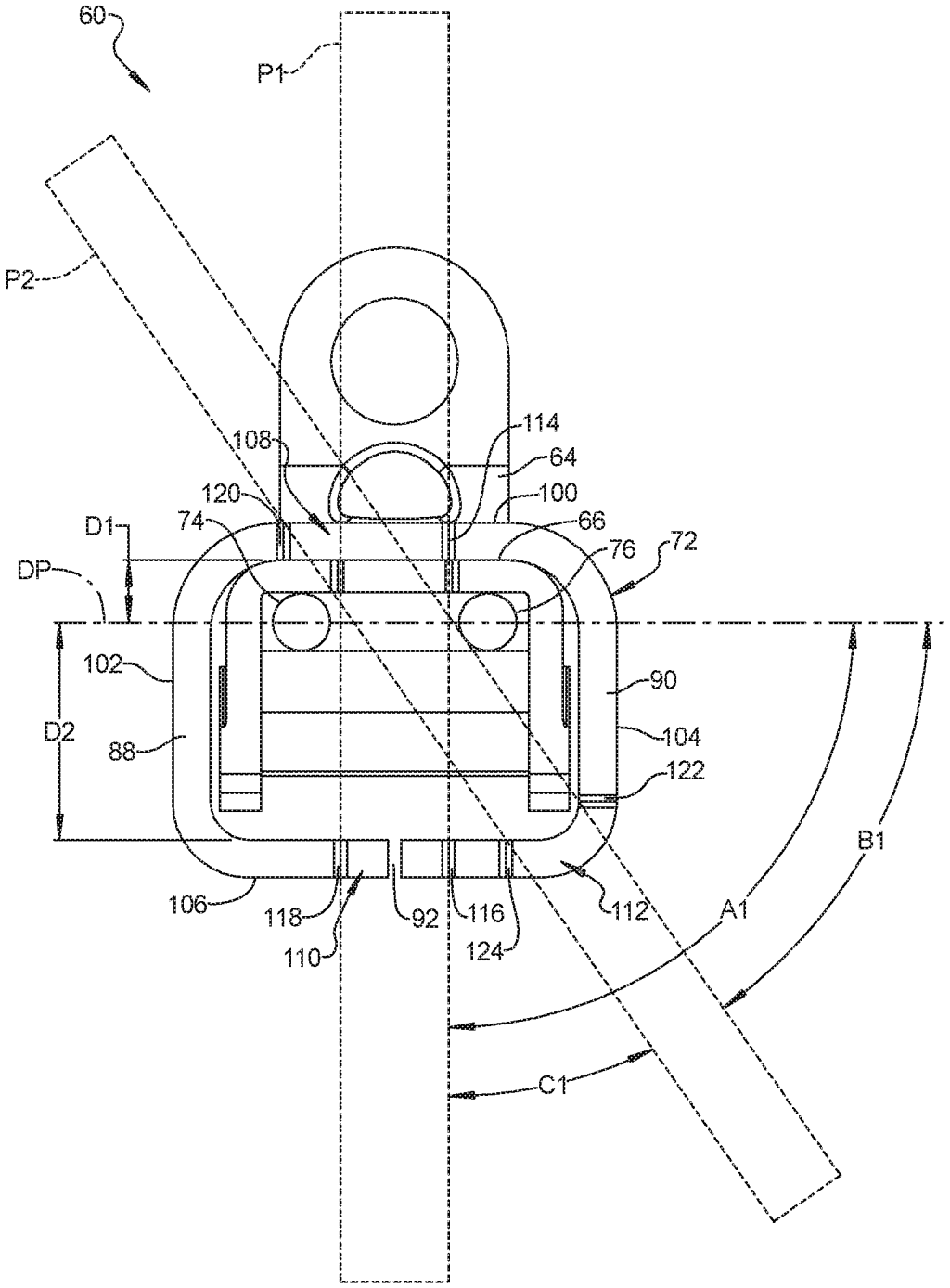
FIG. 7 is the bottom plan view of FIG. 6 showing a wire in first and second wire positioning paths in the example wire alignment contact trip.
Figure 8:
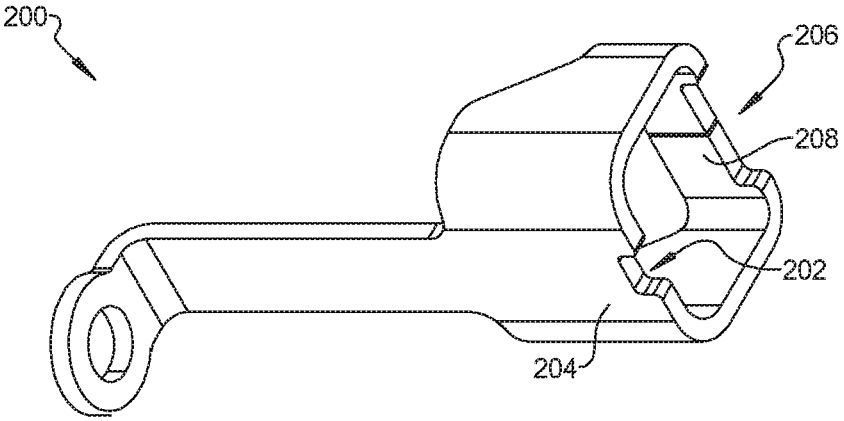
FIG. 8 is a perspective view of another example wire alignment contact trip in accordance with the present disclosure.
Figure 9:
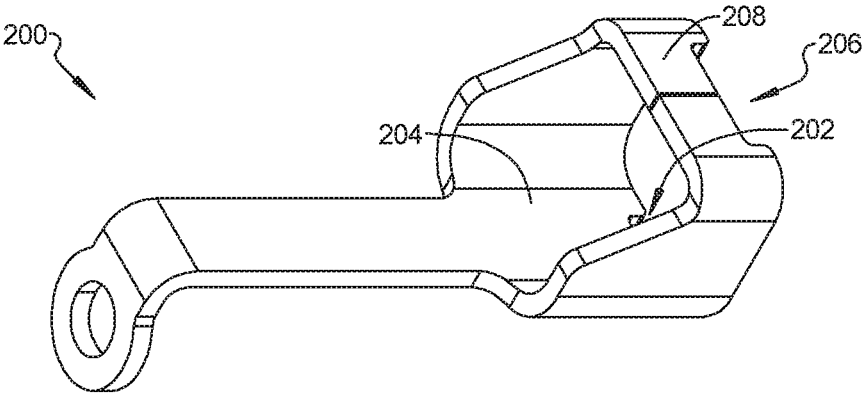
FIG. 9 is another perspective view of the example wire alignment contact trip of FIG. 8 shown from a different angle.

In the example shown in FIG. 7, the leading wall 100 can be positioned at a distance D1 from the drive plane DP. The trailing wall 106 can be positioned at a distance D2 from the drive plane DP. As discussed above, the leading wall 100 can be positioned at the distance D1 from the drive plane DP such that the leading wall 100 is closer to the drive plane DP than the trailing wall 106. In the example shown, the leading wall 100 is positioned at the distance D1 that can measure 4.8 mm and the trailing wall 106 can be positioned at the distance D2 such that the distance D2 measures 17.2 mm. In this example, the trailing wall 106 is positioned more than three times further away from the drive plane DP than the leading wall 100. In other examples, the distances D1 and D2 can have other values and the leading wall 100 and the trailing wall 106 can be positioned from the drive plane DP at other relative distances.

As shown, the peripheral guide wall 88 includes two or more wire alignment recesses that can be used to align the wire 62. In one example, the contact foot 72 can include a first wire alignment recess 108, a second wire alignment recess 110 and a third wire alignment recess 112. The first wire alignment recess 108 is positioned in the leading wall 100. The first wire alignment recess 108 is a portion of the leading wall 100 that is spaced apart from the distal or workpiece contact edge 90 such that when the wire 62 is positioned in the first wire alignment recess 108 the workpiece contact edge 90 can be pressed against the workpiece 54 and the wire 62 is retained in the first wire alignment recess 108. As such, the depth of the first wire alignment recess 108 is equal to or greater than a width or diameter of the wire 62.

In the example shown, the second wire alignment recess 110 can be positioned opposite to the first wire alignment recess 108 in the trailing wall 106. The second wire alignment recess 110 is a portion of the trailing wall 106 that is spaced apart from the workpiece contact edge 90 such that when the wire 62 is positioned in the second wire alignment recess 110 the workpiece contact edge 90 can be pressed against the workpiece 54 and the wire 62 is retained in the second wire alignment recess 110. As such, the depth of the second wire alignment recess 110 is equal to or greater than a width or diameter of the wire 62.

The third wire alignment recess 112, in the example shown, can be positioned in both the trailing wall 106 and the second side wall 104. In this example, the third wire alignment recess 112 is positioned at the intersection of the trailing wall 106 and the second side wall 104 such that the third wire alignment recess 112 extends around the corner of the peripheral guide wall 88. As such, the third wire alignment recess 112 can have a curved, J-shaped or L-shaped cross-sectional profile. The third wire alignment recess 112 is a portion of the trailing wall 106 and/or the second side wall 104 that is spaced apart from the workpiece contact edge such that when the wire 62 is positioned in the third wire alignment recess 112 the workpiece contact edge 90 can be pressed against the workpiece 54 and the wire 62 is retained in the third wire alignment recess 112. As such, the depth of the third wire alignment recess 112 is equal to or greater than a width or diameter of the wire 62.

As shown in FIG. 7, the first wire alignment recess 108, the second wire alignment recess 110 and the third wire alignment recess 112 are positioned relative to one another in the contact foot 72 to define one or more wire positioning paths in the contact foot 72 to align the wire 62 in a desired orientation. As discussed above, it is desirable that the contact foot 72 defines at least two different wire positioning paths that may be advantageously used with different workpieces or for different applications. The example wire alignment contact trip 60 defines at least two different wire positioning paths as will be described. The wire alignment contact trip 60 is asymmetrical in that the first wire alignment recess 108 is not centered in the leading wall 100. In addition, the third wire alignment recess 112 is positioned on one side of the peripheral guide wall 88 and not on the other. Furthermore, the wire alignment contact trip 60 is positioned such that the leading wall 100 is positioned closer to the nose 66 (and, in turn, the drive plane DP) than the trailing wall 106. With this configuration, the wire alignment recesses can cooperate to define two different wire positioning paths.

The first wire alignment recess 108 and the second wire alignment recess 110 can cooperate to define a first wire positioning path P1. The wire 62 can be routed or positioned in the contact foot 72 such that the wire 62 is positioned in the first wire alignment recess 108 at or near a middle edge 114 of the first wire alignment recess 108 and in the second wire alignment recess 110. The wire 62 can be positioned at any lateral position in the second wire alignment recess 110. As shown, in the first wire positioning path P1, the wire 62 is positioned between the first leg 74 and the second leg 76. Thus, the wire alignment contact trip 60 positions the nose 66 relative to the wire 62 to avoid the first leg 74 and the second leg 76 from being driven into the wire 62.

When the wire 62 is positioned along the first wire positioning path P1, the wire 62 can be aligned through the first wire alignment recess 108 and the second wire alignment recess 110 in a path that is substantially perpendicular to a drive plane DP. The drive plane DP, in the example shown, is a plane that extends longitudinally though the nose 66 of the nosepiece assembly 58 and through the centers of the first leg 74 and the second leg 76 of the staple 52. In the example shown, a middle edge 116 of the second wire alignment recess 110 is vertically aligned with the middle edge 114 of the first wire alignment recess 108. The outer edge 118 of the second wire alignment recess is laterally spaced apart from the middle edge 114 of the first wire alignment recess 108 and the middle edge 116 of the second wire alignment recess 110. This configuration permits the first wire positioning path P1 to position the wire 62 in an orientation relative to the drive plane DP that is not precisely perpendicular. For example, the previously described configuration can permit the first wire positioning path P1 to position the wire 62 in an orientation relative to the drive plane DP at an angle in the range of approximately 90 to 70 degrees.

As shown, the first wire alignment recess 108 has a length L1 that is greater than a length L2 of the second wire alignment recess 110. The first wire alignment recess 108, however, can be less than a combined (or overall) length CL1 of the length L2 of the second wire alignment recess and a length of the third wire alignment recess 112. The third wire alignment recess 112 can have a length measured along a center line of the peripheral guide wall 88 between the upper edge 122 and the lower edge 124. The combined length CL1, in the example shown, is greater than the length L1 of the first wire alignment recess 108. The second wire alignment recess 110 can have a length L2 that permits the first wire positioning path P1 to be oriented relative to the drive plane DP at an angle other than 90 degrees while still avoiding alignment of the wire 62 in a path in which the first leg 74 and/or the second leg 76 of the staple 52 would be driven into the wire. In the example shown, the first wire alignment recess 108 has a length of approximately 13 mm and the second wire alignment recess 110 has a length of approximately 8.5 mm. The combined length CL1, in this example, is approximately 15 mm. With this sizing and relative positioning of the first wire alignment recess 108 to the second wire alignment recess 110, the first wire positioning path P1 can position the wire 62 at an angle A1 relative to the drive plane DP of approximately 90 to 110 degrees. In other examples, the relative sizing and positioning can have other values and configurations.

The wire alignment contact trip 60 can also define a second wire positioning path P2. The second wire positioning path P2 can be aligned through the first wire alignment recess 108 and through the third wire alignment recess 112 to define a path that is oriented at an oblique crossing angle relative to first wire positioning path P1. In the second wire positioning path P2, the wire 62 can be aligned from an outer edge 120 of the first wire alignment recess 108 to a lower edge 124 or an upper edge 122 of the third wire alignment recess 112. As can be appreciated, the second wire positioning path P2 can also be described as being oriented at an oblique angle relative to the drive plane DP. When the wire 62 is positioned along the second wire positioning path P2, the wire extends from the outer edge 120 of the first wire alignment recess 108 and through the third wire alignment recess 112. The wire 62 can be positioned at various positions within the third wire alignment recess 112 between the upper edge 122 and the lower edge 124.

When the wire 62 is positioned along the second wire positioning path P2, the wire 62 can be oriented at various acute angles B1 relative to the drive plane DP. In the example shown, the wire 62 can be oriented at an angle B1 that ranges from approximately 33 to 45 degrees. In other examples, the wire alignment contact trip 60 can have other relative sizing and positioning that can define a second wire positioning path P2 at other relative angles. As further shown, the first wire positioning path P1 and the second wire positioning path P2 can be oriented relative to one another at a crossing angle C1. In the example shown, the crossing angle C1 can be an acute crossing angle. The crossing angle C1 can be an acute angle in the range of approximately 45 to 77 degrees. In other examples, the crossing angle C1 can have other values and ranges.

As shown, the first wire positioning path P1 and the second wire positioning path P2 define substantially linear paths in the wire alignment contact trip 60. While the wire 62 may undergo some flexing or bending when the wire alignment contact trip 60 contacts the wire, the flexing or bending is minor such that the wire follows a substantially unimpeded path through the wire alignment contact trip 60 between the first wire alignment recess 108 and the second wire alignment recess 110 and/or between the first wire alignment recess 108 and the third wire alignment recess 112.

FIGS. 8-11 illustrate a second example wire alignment contact trip 200. This example wire alignment contact trip 200 includes many of the same features and/or structure as that previously described with respect to example wire alignment contact trip 60. The example wire alignment contact trip 200 differs from the example wire alignment contact trip 60 in that this example includes only two wire alignment recesses. As shown, the wire alignment contact trip 200 includes a first wire alignment recess 202 and a second wire alignment recess 206.

Figure 11:
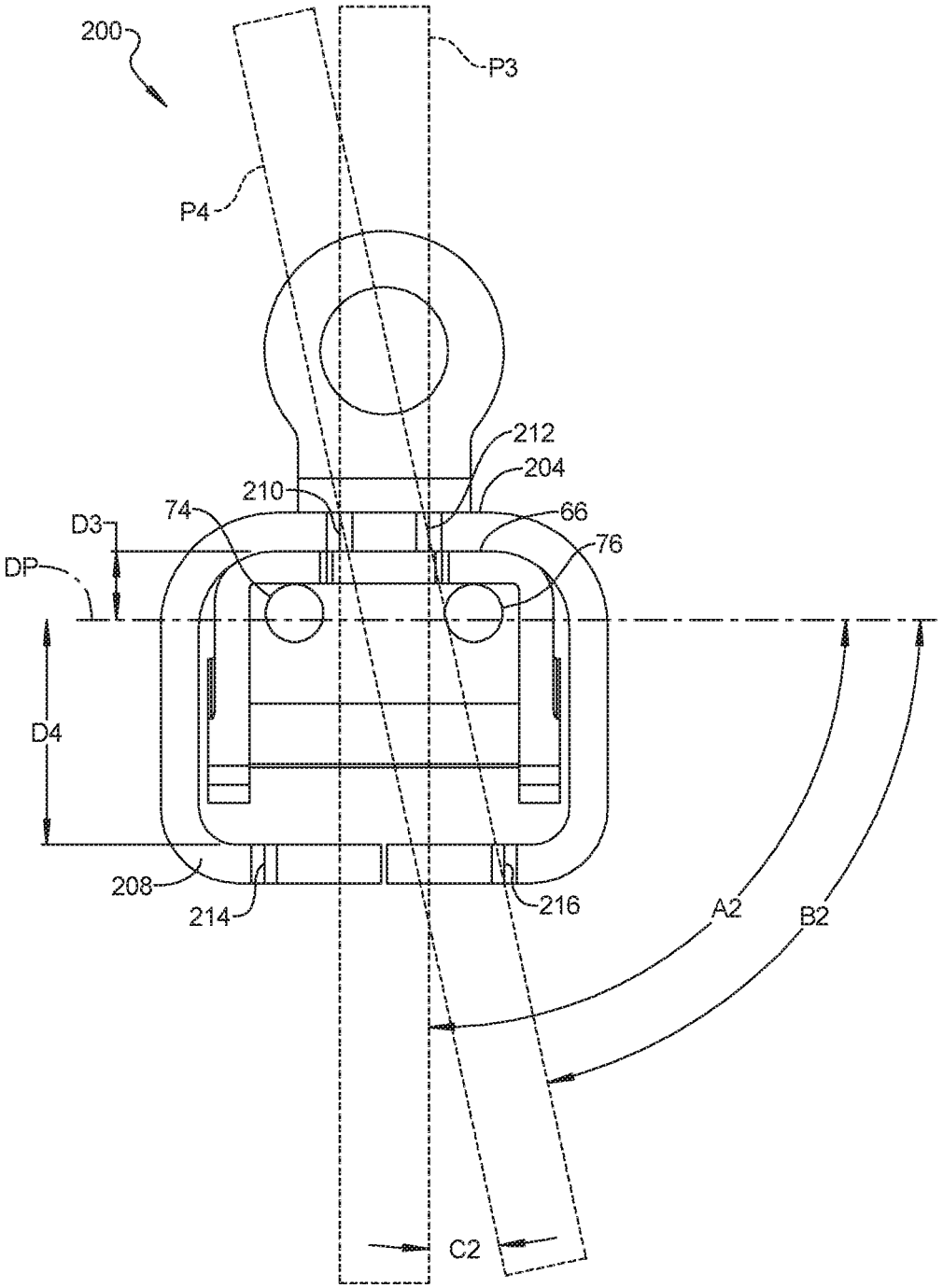
FIG. 11 is the bottom plan view of FIG. 10 showing a wire in first and second wire positioning paths in the example wire alignment contact trip of FIG. 8.

The first wire alignment recess 202 is positioned at a center of the leading wall 204. The second wire alignment recess 206 is positioned opposite to the first wire alignment recess 202 at a center of the trailing wall 208. As shown in FIG. 11, the wire alignment contact trip 200 is positioned relative to the nose 66 (and the drive plane DP) such that the leading wall 204 is closer to the nose 66 than the trailing wall 208. The leading wall 204 can be positioned at a distance D3 from the drive plane DP and the trailing wall 208 can be positioned at a distance D4 from the drive plane DP. Similarly to example contract trip 60, the distance D4 can be three times larger than the distance D3. In other examples, other relative distances can be used.

Figure 10:
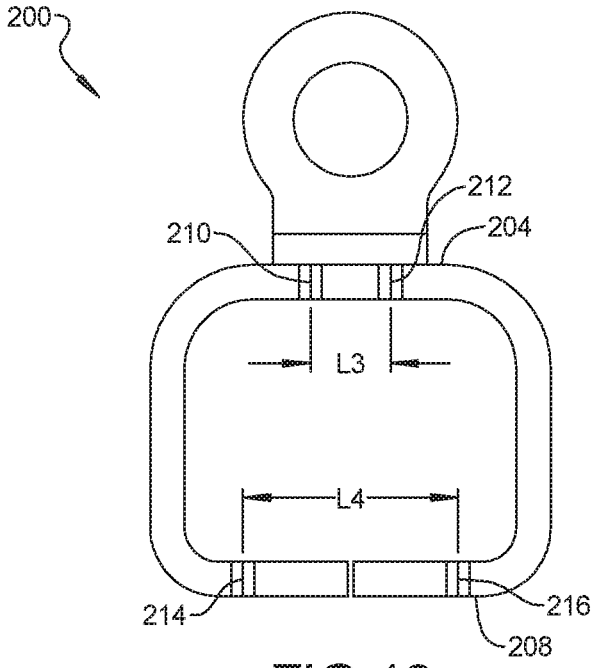
FIG. 10 is a bottom plan view of the example wire alignment contact trip of FIG. 8.

As further shown in FIG. 10, the first wire alignment recess 202 can have a length L3 that is shorter than a length L4 of the second wire alignment recess 206. The length L3 can be less than one half of the length L4. In the example shown, the first wire alignment recess 202 can have a length L3 that is approximately 7 mm. The second wire alignment recess 206 can have a length L4 that is approximately 19 mm. In other examples, the first wire alignment recess 202 recess and/or the second wire alignment recess 206 have other relative sizing.

As can be appreciated, the example wire alignment contact trip 200 includes a pair of wire alignment recesses with the first wire alignment recess 202 opposing the second wire alignment recess 206. The first wire alignment recess 202 and the second wire alignment recess 206 can cooperate to define wire positioning paths. Unlike example wire alignment contact trip 60, the example wire alignment contact trip 200 only includes a single wire alignment recess in the trailing wall 208. Thus, the overall length of the opposing second wire alignment contact trip 206 can be considered as the same as the length L4 of the second wire alignment recess 206.

As shown in FIG. 11, the wire alignment contact trip 200 can define a first wire positioning path P3 and a second wire positioning path P4. The first wire alignment recess 202 and the second wire alignment recess 206 cooperate to define the first wire positioning path P3. When the wire 62 is positioned along the first wire positioning path P3, the wire 62 can be positioned in the first wire alignment recess 202 and in the second wire alignment recess 206 such that the wire 62 is oriented at an angle A2 relative to the drive plane DP. In the example shown, the first wire positioning path P3 is oriented substantially perpendicular to the drive plane DP. The first wire alignment recess 202 and the second wire alignment recess 206 can also cooperate to define the second wire positioning path P4. When the wire 62 is positioned along the second wire positioning path P4, the wire 62 can be positioned adjacent to a first outer edge 210 of the first wire alignment recess 202 and adjacent to a second outer edge 216 of the second wire alignment recess 206. When the wire 62 is positioned in the second wire positioning path P4, the wire 62 is oriented at an oblique crossing angle C2 relative to the first wire positioning path P3 and at an oblique angle B2 relative to the drive plane DP.

When the wire 62 is positioned in the second wire positioning path P4, the wire 62 can be positioned at the angle B2 relative to the drive plane DP. As stated above, the angle B2 can be an oblique angle as shown. In the configuration shown, the angle B2 can have a value of approximately 64 degrees. In other examples, the angle B2 can have other values including values in the range of 60 to 70 degrees. In still others, the angle B2 can have values ranging from 80 to 45 degrees.

As can be appreciated, the wire alignment contact trip 200 with the first wire alignment recess 202 and the second wire alignment recess 206 can define other wire positioning paths. For example, the wire 62 can be positioned adjacent to a second outer edge 212 of the first wire alignment recess 202 and adjacent to the first outer edge 214 of the second wire alignment recess 206. In other wire positioning paths the wire 62 can be positioned at other locations and orientations in both the first wire alignment recess 202 and the second wire alignment recess 206. In the first wire positioning path P3 and in the second wire positioning path P4 and in other wire positioning paths, the wire 62 is positioned relative to the drive plane DP (and relative to the first leg 74 and the second leg 76 of the staple 52) such that the first leg 74 and the second leg 76 do not contact the wire 62 when the staple 52 is driven into a workpiece 54 (i.e., the first wire positioning path P3 and/or the second wire positioning path P4 do not intersect a staple leg path of the staple 52 when the staple 52 exits the nose 66).

As previously discussed, the first wire positioning path P3 and the second wire positioning path P4 define substantially linear paths in the wire alignment contact trip 200. While the wire 62 may undergo some flexing or bending when the wire alignment contact trip 200 contacts the wire, the flexing or bending is minor such that the wire follows a substantially unimpeded path through the wire alignment contact trip 200 between the first wire alignment recess 202 and the second wire alignment recess 206.

In other examples in accordance with the present disclosure, the contact foot 72 and/or other wire aligning aspects of the wire alignment contact trip 60 and the wire alignment contact trip 200 can be used on wire alignment guides that may not be combined wire alignment contact trips as discussed above. For example, the contact foot 72 can be used without the contact arm 64. In such an example, the contact foot 72 with the guide wall 88 and the first wire alignment recess 108, the second wire alignment recess 110 and the third wire alignment recess 112 can be connected at the nose 66 of the stapling tool 48 (or other tool). The contact foot 72, in such an example, may not be movable and may not serve as the contact trip to move the tool from the inactive state to the active state. A separate contact trip can be included in the stapling tool 48.

In another example, a wire alignment guide can be used in which the wall 204 of the wire alignment contact trip 200 is used without the contact arm. In such an example, the wall 204 with the first wire alignment recess 202 and the second wire alignment recess 206 can be connected to the nose 66 of the stapling tool 48 or otherwise fixed relative to the nose 66. In such an example, a separate contact trip can be used to move the tool from the inactive state to the active state.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Terms such as "first," "second," and other numerical terms when used herein do not imply a sequence or order unless clearly indicated by the context.

Similarly, spatially relative terms, such as "inner," "outer," "beneath," "below," "lower," "above," "upper," and the like, are used herein for ease of description to describe one element or feature's relationship to another element(s) or feature(s) as illustrated in the figures. Spatially relative terms are intended to encompass different orientations of the device in use or operation in addition to the orientation depicted in the figures.

What is claimed is:

1. A stapling tool assembly comprising:

a nosepiece assembly including a driver channel through which a staple is driven into a workpiece, the driver channel defining a drive plane along which the staple travels before exiting the driver channel; and a contact foot for positioning the nosepiece assembly relative to a wire to avoid a staple leg from being driven into the wire, the contact foot including a peripheral guide wall defining a workpiece contact edge of the contact foot having at least one wire alignment recess in the workpiece contact edge and at least one opposing wire alignment recess in an opposing side of the workpiece contact edge, the at least one wire alignment recess and the at least one opposing wire alignment recess cooperating to define a first wire positioning path and a second wire positioning path to align the wire in two different orientations relative to the drive plane, the at least one wire alignment recess having a first overall length that is different than a second overall length of the at least one opposing wire alignment recess.

2. The stapling tool assembly of claim 1 further comprising a wire alignment contact trip including the contact foot, wherein:

the wire alignment contact trip is coupled to an activation switch of the stapling tool assembly having an active state and an inactive state;

a biasing force biases the wire alignment contact trip toward an extended position and the wire alignment contact trip is movable against the biasing force into a retracted position; and the activation switch is in the active state when the wire alignment contact trip is in the retracted position, and the activation switch is in the inactive state when the contact trip is in the extended position.

3. The stapling tool assembly of claim 1 wherein the first wire positioning path and the second wire positioning path are substantially linear paths between the at least one wire alignment recess and the at least one opposing wire alignment recess.

4. The stapling tool assembly of claim 1 wherein the peripheral guide wall has a rectangular cross-sectional shape positioned around the nosepiece assembly.

5. The stapling tool assembly of claim 1 wherein the first wire positioning path and the second wire positioning path are oriented relative to the drive plane such that the wire positioned along the first wire positioning path or the second wire positioning path does not intersect a staple leg path of the staple when the staple exits the driver channel.

6. The stapling tool assembly of claim 1 wherein the at least one wire alignment recess is positioned closer to the drive plane than the at least one opposing wire alignment recess.

7. The stapling tool assembly of claim 1 wherein the first wire positioning path and the second wire positioning path are oriented relative to one another at an acute crossing angle that is greater than 10 degrees.

8. The stapling tool assembly of claim 1 wherein the first wire positioning path and the second wire positioning path are oriented relative to one another at an acute crossing angle in a range of 10 degrees to 70 degrees.

9. The stapling tool assembly of claim 1 wherein:

the at least one wire alignment recess includes a single wire alignment recess positioned substantially parallel to the drive plane in the peripheral guide wall, the first overall length of the at least one wire alignment recess defined by a length of the single wire alignment recess; and the at least one opposing wire alignment recess includes a single opposing wire alignment recess positioned parallel to the drive plane in the peripheral guide wall on a side of the drive channel opposite to the single wire alignment recess, the second overall length of the at least one opposing wire alignment recess defined by a length of the single opposing wire alignment recess.

10. The stapling tool assembly of claim 9 wherein the length of the single wire alignment recess is less than one half of the length of the single opposing wire alignment recess.

11. The stapling tool assembly of claim 1 wherein:

the at least one wire alignment recess includes a first wire alignment recess positioned substantially parallel to the drive plane in the peripheral guide wall, the overall length of the at least one wire alignment recess defined by a length of the first wire alignment recess; and the at least one opposing wire alignment recess comprises a second wire alignment recess and a third wire alignment recess, the second wire alignment recess positioned parallel to the drive plane in the peripheral guide wall on a side of the drive channel opposite to the first wire alignment recess, the third wire alignment recess positioned adjacent the second wire alignment recess, the overall length of the at least one opposing wire alignment recess is defined by a combined length of the second wire alignment recess and the third wire alignment recess.

12. The stapling tool assembly of claim 11 wherein the length of the first wire alignment recess is less than the combined length of the second wire alignment recess and the third wire alignment recess.

13. The stapling tool assembly of claim 11 wherein the third wire alignment recess has a curved cross-sectional profile.

14. The stapling tool assembly of claim 11 wherein the peripheral guide wall has a rectangular profile with a leading wall, a trailing wall, a first side wall and a second side wall, the first wire alignment recess located in the leading wall, the second wire alignment recess located in the trailing wall and the third wire alignment recess located at an intersection of the trailing wall and the second side wall.

15. The stapling tool assembly of claim 11 wherein the first wire alignment recess and the second wire alignment recess define the first wire positioning path and the first wire alignment recess and the third wire alignment recess define the second wire positioning path.

16. A stapling tool assembly comprising:

a nosepiece assembly including a driver channel through which a staple is driven into a workpiece, the driver channel defining a drive plane along which the staple travels before exiting the driver channel;

a wire alignment contact trip including:

a contact foot for positioning the nosepiece assembly relative to a wire to avoid a staple leg from being driven into a wire, the contact foot including a leading side and a trailing side joined together to define an enclosure, the leading side positioned opposite to the trailing side and including a first wire recess, the trailing side including a second wire recess and a third wire recess; and a contact trip arm joined to the contact foot and extending away therefrom, the contact trip arm for engaging an activation switch of the stapling tool assembly having an active state and an inactive state, a biasing force biasing the wire alignment contact trip toward an extended position and the wire alignment contact trip is movable against the biasing force into a retracted position, and wherein the activation switch is in the active state when the wire alignment contact trip is in the retracted position, and wherein the activation switch is in the inactive state when the contact trip is in the extended position; and wherein the first wire recess and the second wire recess cooperate to define a first wire positioning path to align the wire in a first path through the first wire recess and the second wire recess that is substantially perpendicular to the drive plane, and the first wire recess and the third wire recess cooperate to define a second wire positioning path through the first wire recess and the third wire recess to align the wire in a second path at an oblique crossing angle relative to the first path.

17. The stapling tool assembly of claim 16 wherein the contact trip arm is joined to the contact foot at the leading side, the contact arm extending away from the leading side in a direction substantially parallel to the drive plane and being connected to the activation switch at a distal end.

18. The stapling tool assembly of claim 16 wherein the first wire positioning path and the second wire positioning path are oriented relative to the drive plane such that the wire positioned along the first wire positioning path or the second wire positioning path does not intersect a staple leg path of the staple when the staple exits the driver channel.

19. The stapling tool assembly of claim 16 wherein the third wire recess is laterally offset from the first wire recess.

20. The stapling tool assembly of claim 16 wherein the contact foot further includes a first lateral side and a second lateral side positioned between the leading side and the trailing side to define a rectangular enclosure including an intersection between the trailing side and the second lateral side, and the third wire recess extends through the intersection between the trailing side and the second lateral side.

21. The stapling tool assembly of claim 16 wherein the oblique crossing angle is an acute angle greater than 10 degrees.

* * * * *